United States Patent [19]

Ogishi

[11] 4,067,144

[45] Jan. 10, 1978

[54] METHOD OF DRIVING DOOR OF AUTOMATIC DOOR ASSEMBLY

[75] Inventor: Masaaki Ogishi, Kurobe, Japan

[73] Assignee: Yoshida Kogyo K.K., Tokyo, Japan

[21] Appl. No.: 688,944

[22] Filed: May 24, 1976

[30] Foreign Application Priority Data

May 24, 1975 Japan ..... 50-62107

[51] Int. Cl.[2] ..... E05F 15/18

[52] U.S. Cl. ..... 49/360; 49/138; 49/29

[58] Field of Search ..... 49/360, 138, 275, 29, 49/263, 264, 267; 318/135

[56] References Cited

U.S. PATENT DOCUMENTS 3,621,349 11/1971 Reyz ..... 49/360 X

*Primary Examiner*—Kenneth Downey

*Attorney, Agent, or Firm*—Hill, Gross, Simpson, Van Santen, Steadman, Chiara & Simpson

[57] ABSTRACT

A method of driving a door of an automatic door assembly by a linear motor mounted within the automatic door assembly. The method comprises the steps of driving the door by a normal propulsion force of the linear motor and then driving the door by an added propulsion force which is greater than the normal propulsion force, at least during a final portion of the stroke of the door thereby overcoming the reaction force of cushioning devices provided near the ends of the door stroke.

5 Claims, 10 Drawing Figures

PROPULSION FORCE
TIME
OPENING INTERVAL
CLOSING INTERVAL
T
F0
F0
F1

PROPULSION FORCE
TIME
OPENING INTERVAL
CLOSING INTERVAL
T1
T
F0
F1
F0
F1

PROPULSION FORCE
TIME
OPENING INTERVAL
CLOSING INTERVAL
T1'
T1
T'
T
F1
F0
F1
F1
F0
F1

PROPULSION FORCE
TIME
OPENING INTERVAL
CLOSING INTERVAL
T1'
T'
T
F1
F0
F1
F0
F1

METHOD OF DRIVING DOOR OF AUTOMATIC DOOR ASSEMBLY

BACKGROUND OF THE INVENTION

1. Field of the Invention

The present invention relates to a method of driving a door of an automatic door assembly and more particularly, to a method of driving the door by a linear motor mounted within the automatic door assembly.

2. Description of the Prior Art

Automatic door assemblies having a linear motor as a prime mover are advantageous in that the linear motor can drive the door linearly without any special driving power transmission mechanism, the motor is simple and durable in construction, and it can be manufactured less costly. However, they also have disadvantages such that when the propulsion force of the linear motor is too small, the door is retarded and tends to stop before it reaches the end of its stroke, and when the propulsion force is too great, the door is driven so rapidly that the door frame is subjected to the full impact of the moving door. Various attempts have heretofore been made to stop the door exactly at the ends of the door stroke by retarding the door during its stroke, thereby preventing the door from striking the outer frame. One such attempt has been to reduce the speed of the door electrically by giving an opposite propulsion force to the linear motor during a final portion of the door stroke. However, this attempt has led to a drawback in that various intricate control devices such as a speed detecting device and a position detecting device which must be adjusted precisely need to be added to the automatic door assembly. Another such attempt has been to provide a pair of cushioning devices such as self-returning type air cylinders at the ends of stroke of the movable door so as to dampen the door speed mechanically.

A problem with the automatic door assembly having the cushioning devices is that the propulsion force of the linear motor must be held at all times to a level sufficiently large to overcome frictional resistance of the door and linear motor and reaction force of the cushioning device. Thus, when the linear motor, especially its reaction rod, is subjected to a voltage decrease (arising from fluctuation of a power supply) and a temperature rise (due primarily to frequent opening and closing of the door), the propulsion force of the linear motor is decreased, and the door tends to be stopped by the reaction force of the cushioning device before reaching the end of the door stroke. This result is disadvantageous especially when the door is to be closed.

One solution to the above shortcoming would be to provide a feedback control device whereby the voltage fluctuation of the power supply and the temperature rise of the linear motor are detected to automatically correct the reduction of the propulsion force of the motor. This solution is however also disadvantageous because the overall structure of the automatic door assembly becomes much more complicated.

SUMMARY OF THE INVENTION

It is a principal object of the present invention to provide a method of driving a door of an automatic door assembly.

It is another object of the present invention to provide a method of the type described which is capable of opening and closing the door completely even if the propulsion force of the linear motor becomes reduced due primarily to a downward fluctuation of voltage and a temperature rise caused by frequent openings and closings of the door.

According to the invention, there is provided a method of driving a door of an automatic door assembly, the method comprising the steps of driving the door by a normal propulsion force of the linear motor and driving the door by a propulsion force which is greater than the normal propulsion force, at least during a final portion of the stroke of the door, thereby overcoming the reaction force of cushioning devices provided near the ends of the door stroke.

Many more advantages and features of the present invention will become manifest to those versed in the art upon making reference to the detailed description and the accompanying sheets of drawings in which preferred embodiments incorporating the principles of the present invention are shown by way of illustrative example.

DETAILED DESCRIPTION OF THE PREFERRED EMBODIMENTS

Figure 1:
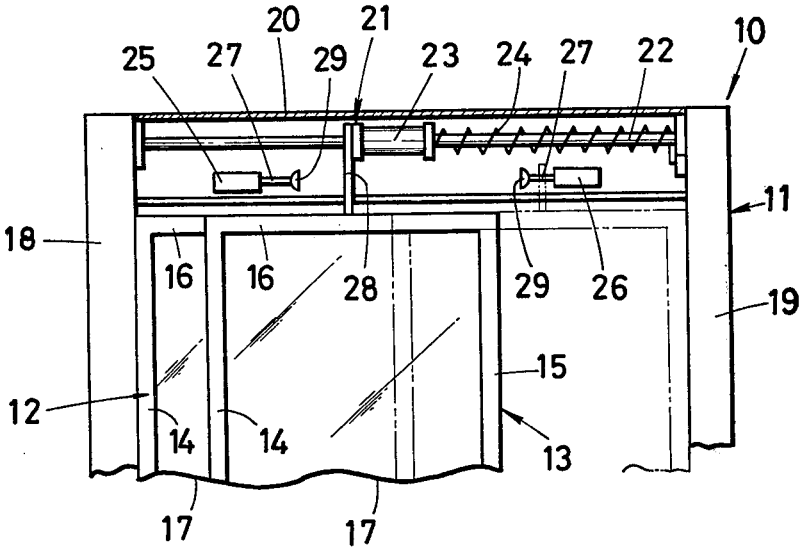
FIG. 1 is a fragmentary front elevational view with parts cut away of an automatic door assembly driven in accordance with a method of the present invention.
Figure 2:
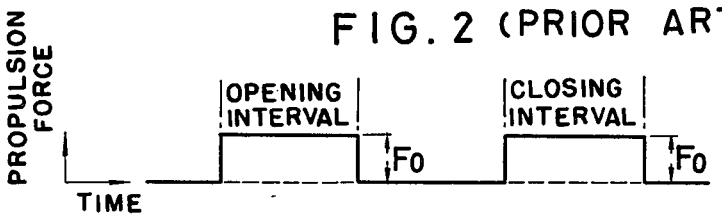
FIG. 2 (PRIOR ART)
FIG. 2 is a graph showing the relation between time and propulsion force of a linear motor actuated according to a conventional driving method.

As shown in FIG. 1, an automatic door assembly 10 generally comprises an outer frame 11 to be mounted in a portal in a building and a pair of doors 12, 13, the door 12 being fixed to the frame 11 and the door 13 being horizontally movable within the frame 11 in order to open and close the portal. Each of the doors 12, 13 has an inner frame including a pair of stiles 14, 15, a top rail 16, and a glass pane 17 surrounded and held in place by the inner frame. The outer frame 11 has a pair of side jambs 18, 19 and a head 20 interconnecting the top ends of the side jambs 18, 19.

The head 20 contains therein a linear motor 21 having a reaction rod 22 extending horizontally between the side jambs 18, 19 and a movable member 23 in the form of a hollow cylinder fitted over the rod 22 with a clearance therebetween, the movable member 23 having a pair of coils for providing a shifting magnetic field. A power cable 24 extends from one of the side jambs, here the jamb 19, around the reaction rod 22 to the movable member 23 where it is connected to the windings. The head 20 also has a pair of air cushion cylinders 25, 26 of the self-returning type mounted therein and spaced apart a distance substantially equal to the stroke of the movable door 13, the cylinders 25, 26 serving to dampen the movement of the movable door 13 at the ends of its opening and closing strokes.

Each of the air cushion cylinders 25, 26 has a piston rod 27 normally urged to its projecting position by a coil spring, not shown, in the cylinder. The movable member 23 of the linear motor 21 is provided with a downwardly extending bar 28 fixed thereto and having its lower end connected with the central portion of the top rail 16 of the movable door 13. The piston rods 27 have at their distal ends rubber members 29 with which the bar 28 becomes engageable when the door 13 reaches its opened or closed position.

Conventionally, the movable door of the automatic door assembly has been driven by a normal propulsion force $F_0$ from the linear motor during its opening and closing time intervals. By the term "normal propulsion force" is meant a force which is sufficiently large to overcome the frictional resistance of the movable door including the linear motor and which is sufficiently small to prevent the stile 15 of the door 13 from striking the side jamb 19 when the door 13 is closed.

Figures 3A, 3B, 3C, 3D:
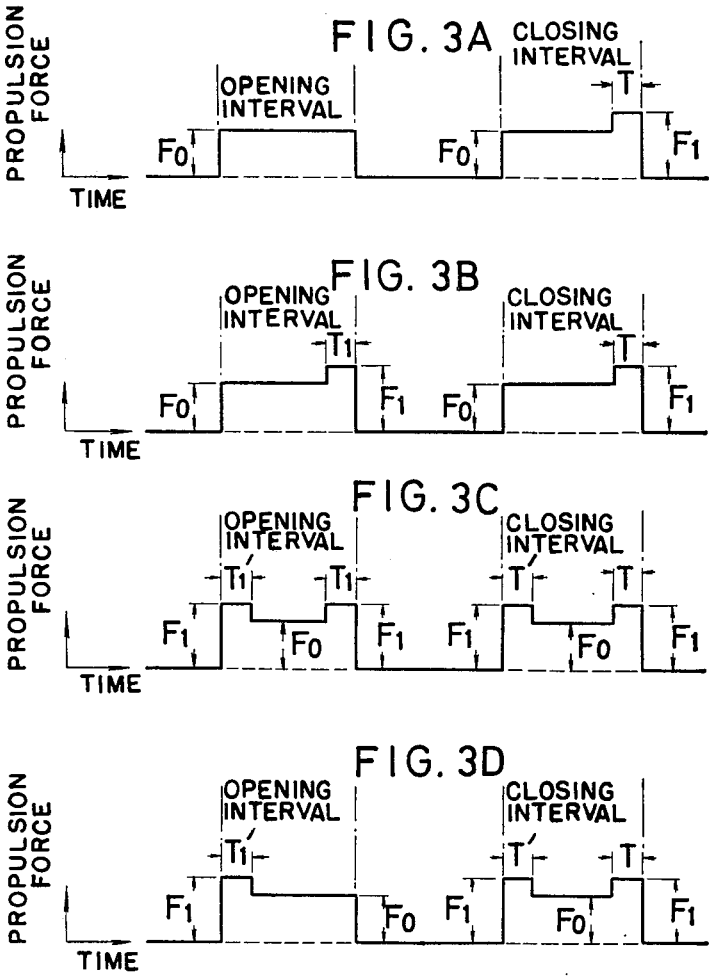
FIGS. 3A through 3D are graphs each showing the relation between time and propulsion force of the linear motor actuated according to a method of the present invention.

According to a method of the invention, as shown in FIG. 3A, an additional propulsion force $F_1$ that is greater than the normal propulsion force $F_0$ is provided at a final portion T of the door closing time interval, thereby completely closing the door 13 against the reaction force of the air cushion cylinder 26 even if the normal propulsion force of the linear motor 21 becomes reduced due to a voltage decrease and a temperature rise of the motor 21 while the door 13 is opened and closed frequently.

In FIG. 3B, the additional propulsion force $F_1$ is also applied at an initial portion $T_1$ of the door opening interval to overcome the reaction force of the air cushion cylinder 25, so that the door 13 can be fully opened.

FIG. 3C shows the application of an additional propulsion force $F_1$ to the pattern of FIG. 3B at initial portions T', $T'_1$ of the closing and opening intervals, respectively, whereby the linear motor 21 is driven to move the door 13 rapidly against the inertia by which door 13 remains at rest, when the latter starts to be opened and closed. With this pattern of operation, the door 13 can be driven at maximum speed.

Since the door 13 is permitted to stop short of its fully opened position, it may be driven in accordance with an operation pattern of FIG. 3D in which the additional propulsion force $F_1$ is removed from the final portion of the door opening interval.

Figure 4:
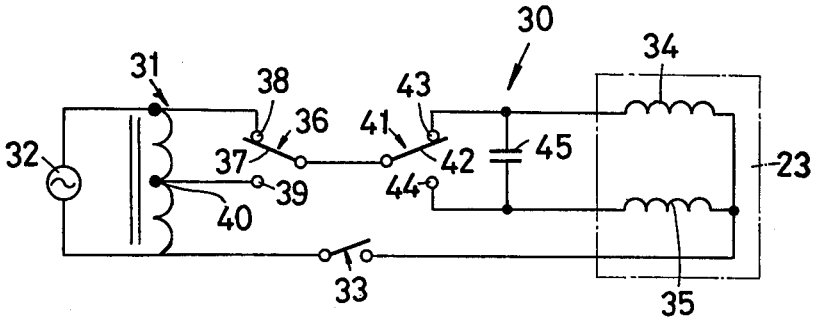
FIGS. 4 through 6 are circuit diagrams for controlling the linear motor in according with the invention.

FIG. 4 illustrates an electric circuit 30 provided for effecting the method according to this invention. The circuit 30 includes an autotransformer 31 connected at its end terminals to a single-phase a.c. source 32. A main switching relay 33 has contacts connected between one of the end terminals of the autotransformer 31 and a common terminal of a pair of parallel-connected first and second coils 34, 35 mounted within the movable member 23 of the linear motor 21. There is provided a first relay 36 of the single-pole double-throw type having a movable pole 37 and two contacts 38, 39, the contact 38 being connected to the other end terminal of the autotransformer 31 and the contact 39 to a tap 40 of the autotransformer 31. The first relay 36 is normally de-energized during which time the pole 37 contacts the contact 38. A second relay 41 of the single-pole double-throw type is provided which has a movable pole 42 coupled with the movable pole 37 of the first relay 36. A contact 43 of the second relay 41 is connected to the first winding 34 and a contact 44 is connected to the second winding 35. The second relay 41 is normally de-energized during which time the movable pole 42 contacts the contact 43. Connected across the contacts 43, 44 of the second relay 41 is a capacitor 45 serving as a phase-advancer for one of the windings 34, 35 which is selected by the second relay 41.

Assuming that the contacts of the main relay 33 are closed and the first and second relays 36, 41 are de-energized, the full voltage of the power source 32 is applied to the winding 34 and, through the capacitor 45, the winding 35, when the door 13 is driven by the propulsion force $F_1$ which is greater than the normal propulsion force $F_0$. When the first relay 36 is actuated to shift the movable pole 37 to the contact 39, a voltage which is produced by dropping the power supply voltage through the autotransformer 31 is applied to the winding 34 and, through the capacitor 45, the winding 35, whereupon the door 13 is driven by the normal propulsion force $F_0$. The direction of movement of the movable member 23 of the linear motor 21 can be changed by shifting the movable pole 42 from the contact 43 to the contact 44 or vice versa, the switching of the relay 41 being the switching of direction of the shifting magnetic field formed by the windings 34, 35. The autotransformer 31 may be a variable-ratio autotransformer whereby its output voltage across the common line can be varied continuously.

Figure 7:
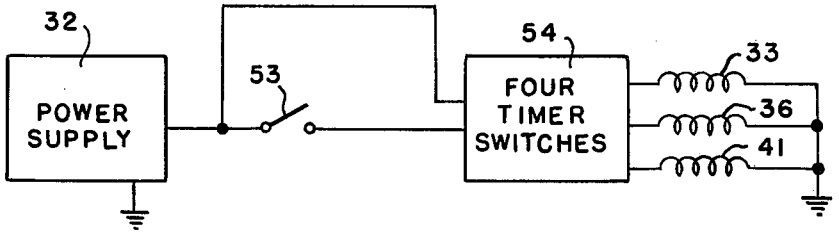
FIG. 7 is a control diagram.

With the circuit construction of FIG. 4, a mode of operation of the automatic door assembly 10 according to the pattern of FIG. 3C is described below. There are provided four timers or timer switches 54 (FIG. 7) operatively associated with the circuit components. More specifically, a first timer switch serves to determine a time interval during which the door is opened. That is, when a switch 53 under a door mat, on the floor is activated, the first timer switch connected to the relay 41 sets a time interval after which the door starts closing. A second timer switch is energized when the main relay 33 is actuated and, after the lapse of a preset time interval which is slightly longer than the door opening interval, the second timer turns the main relay 33 off. A third timer switch is actuated at the same time as the second timer switch and, after the lapse of a time interval of the initial portion $T'_1$, energizes the first relay 36 and, after the lapse of a preset time interval, de-energizes the first relay 36. A fourth timer switch is energized when the second relay 41 is actuated and, after the lapse of a preset time interval which is longer than the door opening interval, de-energizes the second relay 41 again.

When a person steps on the door mat, the switch under the mat is thrown to actuate the main relay 33 and the second relay 41, the first relay 36 remaining de-energized. The door 13 starts opening and is driven by the additional propulsion force $F_1$ during the initial portion $T'_1$ of the opening interval. After the lapse of the initial time interval $T'_1$, the third timer switch actuates the first relay 36 to apply a dropped voltage to the first and second coils 34, 35, thereby propelling the door 13 by the normal propulsion force $F_0$. Upon lapse of a preset time interval, the first relay 36 is de-energized again by the third timer switch, so that the door 13 is driven by the propulsion force $F_1$. Simultaneously with the lapse of the door opening interval, the second timer switch de-energizes the main relay 33 thereby completing the opening of the door 13. After the switch under the door mat has opened in response to passage of the person through the door, the first timer switch is operated, after a preset time interval, to actuate the main switching relay 33 so as to initiate the door closing operation. The second relay 41 is de-energized by the fourth timer switch anywhere between the opening time interval and the closing interval. The sequence of switching of the relays 33 and 36, and operation of the second and third time switches during the door closing operation is completely identical to that during the door opening operation.

Figure 5:
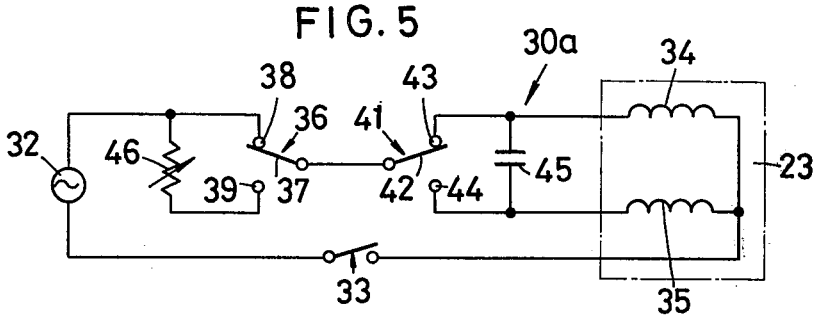

FIG. 5 illustrates a linear motor control circuit 10*a* constructed in accordance with another embodiment, wherein a variable resistor 46 is used instead of the autotransformer 31 in the circuit 30 shown in FIG. 4.

Figure 6:
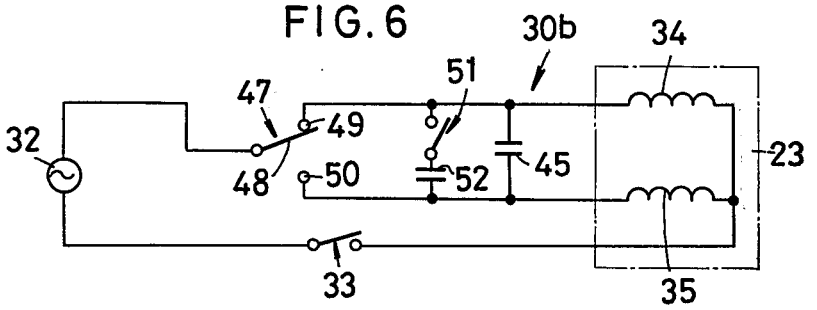

According to still another embodiment shown in FIG. 6, a control circuit 30*b* includes a single-pole double-throw type relay 47 having a movable pole 48 connected to one terminal of the power supply 32 and a pair of contacts 49, 50, the contact 49 being coupled to the first coil 34 and the contact 50 to the second coil 35. There is provided another relay 51 connected in series with a capacitor 52, the relay 51 and the capacitor 52 being connected in parallel with the capacitor 45. The relay 47 is used to change the direction of the shifting magnetic field formed by the windings 34, 35. The relay 51 serves to vary the strength of the propulsion force of the linear motor.

Although various minor modifications may be suggested by those versed in the art, it should be understood that I wish to embody within the scope of the patent warranted hereon, all such embodiments as reasonably and properly come within the scope of my contribution to the art.

What I claim as my invention:

1. A method of using a linear motor for driving a door of an automatic door assembly of the type having a pair of cushioning devices for dampening the movement of the door at the ends of its opening and closing strokes, comprising the steps of:

a. driving the door throughout the duration of each stroke by a normal constant propulsion force obtained from the linear motor;

b. driving the door by an additional constant propulsion force, which produces a net force which is greater than said normal propulsion force, during a final portion of at least one of the strokes of the door for thereby overcoming a reaction force of one of the cushioning devices so as to bring the door completely to the end of said one of its strokes; and c. removing said additional propulsion force upon arrival of the door at said end.

2. A method according to claim 1, further comprising the step of driving the door by the additional propulsion force also during an initial portion of at least one of the strokes of the door, for thereby overcoming the inertia by which the door tends to remain at rest.

3. A method according to claim 1 in which said additional propulsion force is provided at the final ends of both of said strokes.

4. A method according to claim 1 in which said additional propulsion force is also provided during an initial portion of both of said strokes for overcoming the inertia of rest of the door.

5. A method according to claim 2 in which said additional propulsion force is also provided during an initial portion of both of said strokes.

* * * * *